United States Patent [19]

Eakes et al.

[11] 3,981,055

[45] Sept. 21, 1976

[54] APPARATUS FOR FORMING A YARN PACKAGE

[76] Inventors: James H. Eakes, 12 Granger Drive, Cartersville, Ga. 30120; James G. Henderson; James M. Henderson, both of 441 N. Hamilton St., Dalton, Ga. 30720

[22] Filed: June 17, 1974

[21] Appl. No.: 480,025

[52] U.S. Cl. ..... 28/21; 19/159 R; 242/82; 242/47

[51] Int. Cl.[2] ..... B65H 54/82

[58] Field of Search ..... 28/21; 19/159 R; 242/82, 158.3, 47

[56] References Cited

UNITED STATES PATENTS

| | | | |
|---|---|---|---|
| 2,478,413 | 8/1949 | Merwin | 242/158.3 |
| 3,172,185 | 3/1965 | Langway et al. | 28/21 X |
| 3,226,794 | 1/1966 | Erb | 28/21 |
| 3,316,609 | 5/1967 | Russo | 28/21 |
| 3,478,399 | 11/1969 | Wyatt et al. | 28/21 |
| 3,638,278 | 2/1972 | Johnels | 19/159 R |

FOREIGN PATENTS OR APPLICATIONS

| | | | |
|---|---|---|---|
| 160,359 | 12/1954 | Australia | 28/21 |
| 1,028,736 | 4/1958 | Germany | 28/21 |

*Primary Examiner*—Robert R. Mackey
*Attorney, Agent, or Firm*—Jones, Thomas & Askew

[57] ABSTRACT

Apparatus for forming a yarn package wherein the yarn package includes a plurality of axially stacked revolutions of yarn with each revolution formed to include a plurality of sinuous shaped wave patterns in each revolution, and wherein the sinuous pattern of adjacent revolutions are angularly offset relative to each other to form a yarn package having high porosity in the package to permit the ready flow of yarn treatment material therethrough. The yarn package forming apparatus includes a frame support means having a power driven turntable, with a pressure plate non-rotatably supported thereabove for vertical translating movement, and wherein the yarn package is formed between the rotatable turntable and the pressure plate. The yarn packaging apparatus is provided with a variable speed radially reciprocating yarn guide means for feeding the yarn through a radial slot in the pressure plate to the turntable for forming revolutions of yarn having the sinuous pattern, with each revolution having an adjusted length of yarn. The variable speed radially reciprocating means is provided with a programable speed adjustment mechanism which is operated at a number of independent speeds for a series of revolutions, with the sequence of rotational speed being repeated after a predetermined number of revolutions of the turntable. A yarn package is formed by threading a length of yarn through the yarn guide means and slot, engaging an end of the yarn with the rotary turntable and effecting rotation of the turntable to form the stacked revolutions of yarn which will in turn force the pressure plate upward as the yarn package is formed. An open mesh yarn bag is supported on the turntable with the bag being constructed of net material which will permit ready impregnation of a dye throughout the yarn package.

8 Claims, 13 Drawing Figures

APPARATUS FOR FORMING A YARN PACKAGE

BACKGROUND OF THE INVENTION

This invention relates to yarn package forming apparatus and is more particularly concerned with means for forming a skein of yarn used in various yarn treatment operations in the textile industry, such as in yarn dyeing operations.

A considerable amount of yarn used in the textile industry is wound on cones, which are then processed to form a skein, with the skein being used for treating the yarn in a number of processing operations, such as heat setting and dyeing. There have been a number of prior art apparatus designed which will form a skein of yarn wherein each revolution of a skein is parallel, causing substantial contact with adjacent yarn revolutions. One problem with this type of yarn skein is that the porosity of the yarn package is very dense which will obstruct impregnation of dye material or other yarn treating media.

There have been a number of attempts to provide a yarn skein package having sufficient porosity to permit the dye material to effectively impregnate the revolutions of yarn. One of these prior art yarn packages is formed by making a number of small revolutions of yarn and then successfully applying these small revolutions in a circular path about the axis of rotatable support means, with the plurality of revolutions forming a vertically stacked skein consisting of a number of revolutions. The major disadvantage with this type of yarn package occurs when it is necessary to remove the yarn from the skein package for rewinding the yarn on additional support means, wherein the small revolutions of yarn become tangled, requiring the machine to be stopped.

Another problem with the prior art skein forming apparatus is that a number of skeins are formed simultaneously on a frame support means which is provided with a common drive and control means. After a skein package is formed a doffing operation is effected by stopping the machine and removing the skein. The doffing of the skein from the prior art apparatus requires considerable machine down-time, which substantially reduces the skein production of the machine.

Another problem with the prior art skein forming apparatus is in the backwinding of the skein to cones of material. The prior art backwinding operations requires that the yarn be exhausted from one skein of material and that an additional skein be connected with the machine in a stopped position.

A further problem with the prior art skein packages results from the interwoven length of material used to hold the yarn package together, which yarn package easily becomes disarrayed causing the center opening to be difficult to locate when it is necessary to position the center opening on yarn handling means.

SUMMARY OF THE INVENTION

It is therefore a primary object of the present invention to provide apparatus for forming a skein of yarn which includes sufficient porosity to permit ready impregnation of the yarn with treatment medium.

Another object of the present invention is to provide a yarn packaging apparatus which will form a plurality of revolutions of yarn in an axially stacked array with each revolution having a plurality of circumferentially spaced sinuous shaped waves and with the sinuous shaped waves of adjacent revolutions being angularly offset relative to each other.

A further object of the present invention is to provide a system for packaging a skein of yarn wherein the yarn is enclosed in a yarn bag means.

A still further object of the present invention is to provide a bag for use in containing a skein of yarn.

Yet another object of the present invention is to provide a yarn packaging apparatus which is simple to doff and easy to load on skein handling apparatus.

A still further object of the present invention is to provide an improved yarn package having a number of various length yarn revolutions.

Another object of the present invention is to provide a control system for a yarn packaging apparatus which will permit the apparatus to be selectively programmed for operation through a number of predetermined yarn forming cycles.

A further object of the present invention is to provide a variable speed drive system for controlling the formation of yarn in a skein forming operation.

A still further object of the present invention is to provide a variable resistor electrical input means to a drive motor for use in adjusting the speed of operation of the drive motor.

An additional object of the present invention is to provide a method and apparatus of packaging yarn in a skein which is simple in construction and use, economical to manufacture and reliable in performance.

The above indicated prior art disadvantages have been overcome and the desirable objects are obtained by the present invention which basically includes a rotatable turntable operable for developing a number of stacked revolutions of yarn to form a skein package, and wherein each revolution of yarn includes a plurality of sinuous shaped wave patterns, with adjacent sinuous patterns being angularly offset relative to each other to provide an open porosity package of yarn.

One important feature of the present invention includes a variable speed radial reciprocating drive means which will form the yarn into the sinuous patterns on the rotatable turntable, and wherein the variable speed causes variable length revolutions of yarn to be developed.

A further feature of the present invention includes an open mesh type nylon net used to support and enclose the yarn in a skein package to improve the handling of the package in yarn processing operations.

A further feature of the present invention is the provision of a pressure plate above the rotatable turntable, with the pressure plate detailed for maintaining the revolutions of yarn in a stacked relationship during buildup of the adjacent revolutions.

These and other objects and advantages of the details of construction will become apparent after reading the following description of the illustrative embodiments, with reference to the accompanying drawings wherein like reference numerals have been used to refer to like parts throughout the several figures and wherein:

DESCRIPTION OF THE ILLUSTRATIVE EMBODIMENTS

Figure 1:
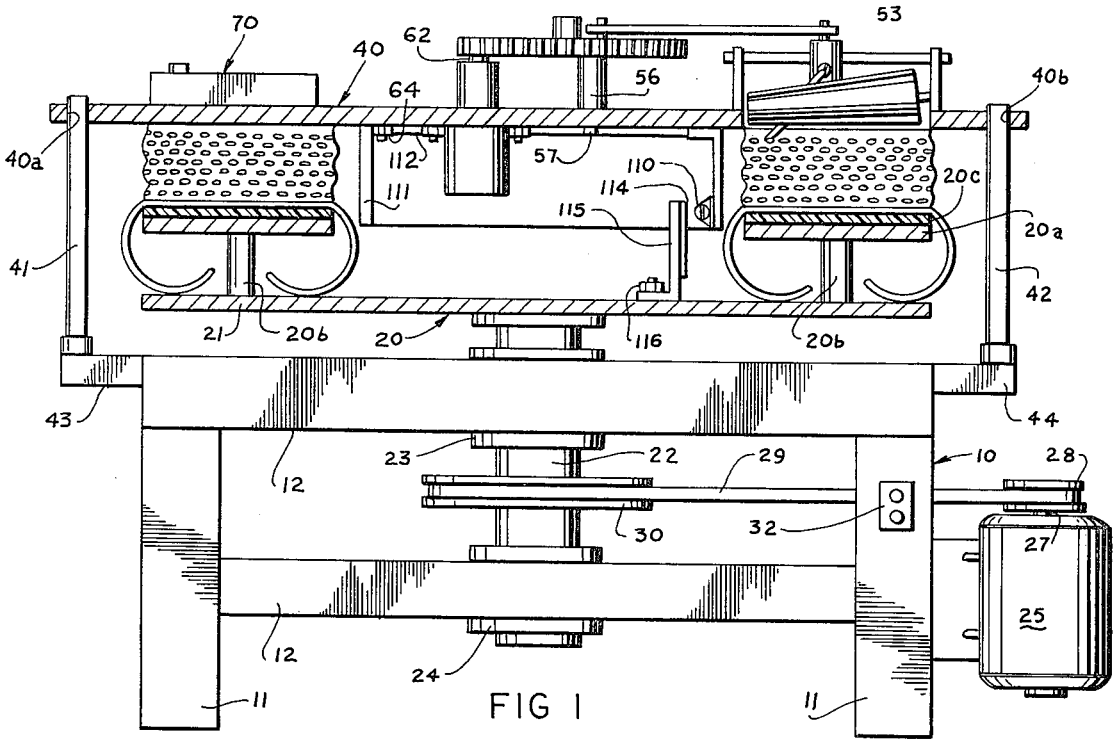
FIG. 1 is an elevational view of a yarn package forming apparatus embodying the principals of the present invention, with certain parts broken away and shown in section for purpose of clarity.

Referring to the drawings, the yarn packaging apparatus is shown and generally represented by the reference numeral 10. The yarn packaging apparatus includes a frame support means constructed to include a number of vertically extending leg support members 11 which are interconnected by a number of horizontally extending frame members 12. The frame members 11, 12 are constructed of conventional metal stock material which are interconnected to each other by conventional means, such as welding (not shown).

As shown in FIG. 1, a turntable means 20 is supported on the frame means for rotation about a substantially vertical axis. The rotary turntable means 20 includes a circular plate element 21 which is supported on the upper end of a vertical support shaft 22. Vertical support shaft 22 is rotatably supported in a pair of vertically spaced bearings 23, 24. Bearings 23, 24 are secured to horizontal frame members 12, as shown in FIG. 1, by conventional bolt connecting means (not shown). Turntable 20 is rotated during cyclic operation of the yarn packaging operation by a conventional electric motor 25 secured to the frame support means by conventional connecting bolts 26. Motor 25 is provided with a drive shaft 27 having a drive pulley 28. Drive pulley 28 is connected by a drive belt 29 to pulley 30 which is fixed to the turntable drive shaft 22. Motor 25 is controlled in an "on" and "off" drive relationship by a conventional control switch 32. Operation of motor 25 will effect rotation of turntable 20 in a clockwise direction, as shown in FIG. 2.

As shown in FIG. 1, the turntable plate 20 is provided with an annular ring member **20*a* concentrically supported relative to the drive shaft axis 22 and is vertically spaced above the turntable plate by a number of circumferentially spaced support members 20*b*. The upper surface of annular plate member 20*a* is provided with a pad or supporting cushion 20*c*** constructed of conventional synthetic material.

The yarn packaging apparatus includes a square-shaped pressure plate 40 which is constructed of conventional metal stock material and is supported above the turntable 20 for non-rotating, vertical translating movement by a pair of upstanding post members 41, 42. Post members 41, 42 are connected to horizontally extending brackets 43, 44, respectively, which are secured to the frame means by conventional means, such as welding.

Figure 2:
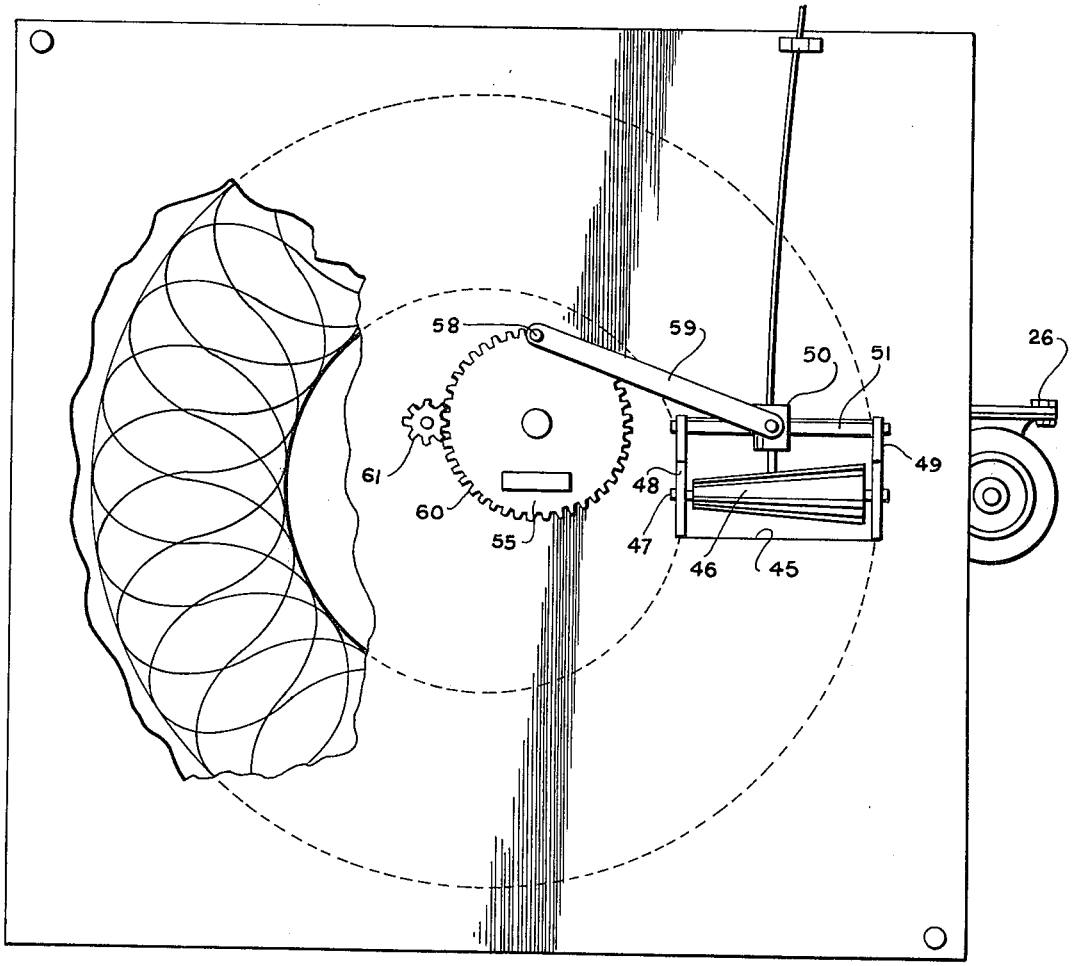
FIG. 2 is a top plan view of the apparatus shown in FIG. 1, with certain parts broken away and shown in section for purpose of clarity.

As shown in FIGS. 1 and 2, the pressure plate 40 is provided with a pair of openings **40*a*, 40*b* which are complimentary to the upstanding post members 41, 41 respectively, and are detailed in location to permit vertical translating movement of the pressure plate 40 above the turntable 20. Pressure plate 40 is provided with a radially spaced, radially extending yarn feed slot 45 through which yarn is introduced to the area between the turntable and the pressure plate for effecting a buildup of a yarn package. The radial dimension of slot 45 is substantially equal to the radial dimension of annular supporting plate 20*a*. The yarn is introduced and guided through the slot 45 by means of a conical shaped rollers 46. Roller 46 is supported by a shaft 47 journaled in a pair of upstanding frame brackets 48, 49 located on opposite radial edges of slot 45. The conical shaped guide roller 46 is detailed so that the axis of the roller extends in a radial direction from the axis of turntable means 20. The dimensions of conical shaped guide roller 46 are detailed such that the surface speed of the guide roller is progressively larger from adjacent the inner edge of annular support plate 20*a* toward the outer edge of annular support plate 20*a*.**

The end of a yarn introduced through slot 45 becomes attached to the turntable means by the friction applied by the pad or supporting cushion **20*c*, as is conventional in the art, so that rotation of the turntable will cause the yarn to be drawn through the slot 45. As the yarn is drawn through the slot 45 and supported on the upper surface of the turntable annular support plate 20*a*, the pressure plate 40 will maintain the yarn in a predetermined path as the yarn advances around and is supported on the upper surface of supporting plate 20*a*. During the feeding operation of the yarn through slot 45, the yarn is caused to radially reciprocate along the radial length of slot 45 so that the yarn will develop a plurality of circumferentially spaced sinuous waves on the upper surface of annular plate 20*a*.**

A radial reciprocating movement of the yarn is effected by means of a reciprocating yarn guide element 50. The reciprocating yarn guide element 50 is supported for reciprocating movement on shaft 51 which is supported above pressure plate 40 by the support brackets 48, 49. The reciprocating guide element 50 is provided with a guide opening 53 through which the yarn is guided as it passes into slot 45. A reciprocating movement of guide element 50 is effected by means of a rotary eccentric member 55. Rotary eccentric member 55 is supported for rotatable movement on the upper surface of pressure plate 40 by a bushing 56 and support shaft 57. Eccentric 55 is provided with a radially displaced connecting pin 58 which is connected by a link member 59 to the yarn guide element 50. The peripheral edge of rotary eccentric member 55 is provided with conventional gear teeth 60 which is supported enmesh with a drive gear 61. Drive gear 61 is fixed to the upper end of a motor drive shaft 62. Drive shaft 62 is provided by a conventional electric motor drive means 63 which is supported beneath pressure plate 40 by a plurality of conventional connecting bolts 64. Rotary movement of eccentric 55 will effect reciprocating movement of yarn guide element 50 so that the yarn will be guided along a path having adjusted radial dimensions to develop the sinuous wave pattern as the yarn is advanced around the upper surface of the annular support 20*a*.

By adjusting the speed of reciprocating movement of the yarn guide element 50, the adjacent revolutions of yarn containing the sinuous wave patterns are angularly offset relative to each other to cause an overlapping relationship of the yarn revolutions to thereby develop voids or to provide a high porosity yarn package. Further, by adjusting the speed of reciprocating movement of the yarn guide element 50, the lengths of yarn in the revolution are of various predetermined length which is desirable in effecting a multi-color dye pattern. The speed of reciprocating movement of yarn guide element 50 is effected by varying the speed of drive motor 63. The speed of drive motor 63 is adjusted with each revolution of the turntable 20*a* by means of a variable resistor drive control means 70.

Figure 7:
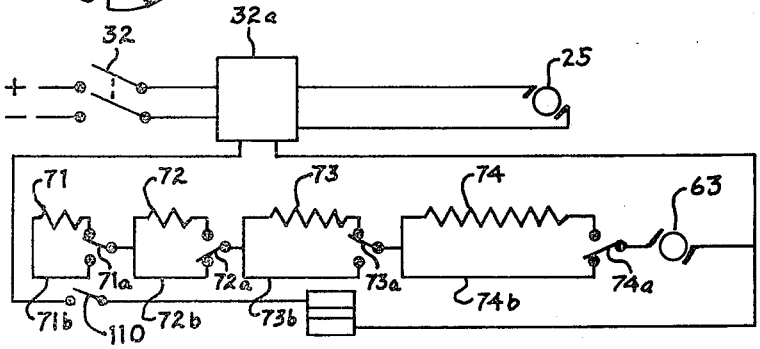
FIG. 7 is an electrical schematic of the variable speed control means.

As shown in the electrical schematic of FIG. 7, the variable resistor drive control means includes four resistors 71, 72, 73 and 74 which are adapted to be connected in series with each other by conventional switch means 71*a*, 72*a*, 73*a* and 74*a*, respectively. Resistor 71 is detailed to have a one unit value resistance, resistor 72 is detailed to have a two unit value resistance, resistor 73 is detailed to have a four unit value resistance and resistor 74 is detailed to have an eight value resistance. Each of the resistors 71 – 74 is provided with a bypass line 71*b*, 72*b*, 73*b*, and 74*b*, respectively. The resistors 71 – 74 can be selectively connected to each other in various combinations of unit resistor capacity in order to vary the electrical input of power to drive motor 63, thereby adjusting the reciprocating speed of yarn guide element 50. The 1, 2, 4, 8 unit value of resistors 71 – 74 will provide a combination of 15 unit value resistance by using conventional binary code combinations so that the motor 63 can be varied through 15 different speeds.

The resistor control switches 71*a* – 74*a* are normally held in a resistor bypass position so that current conducted to motor 63 will be transferred along the resistor bypass lines through predetermined combinations of the resistors 71 – 74 when the control switches 71*a* – 74*a* are moved to an on position. Thus it can be seen that by varying the closure of resistor control switches 71*a* – 74*a*, the amount of current transferred to the drive motor 63 can be adjusted to 15 different unit values of current.

Figure 3:
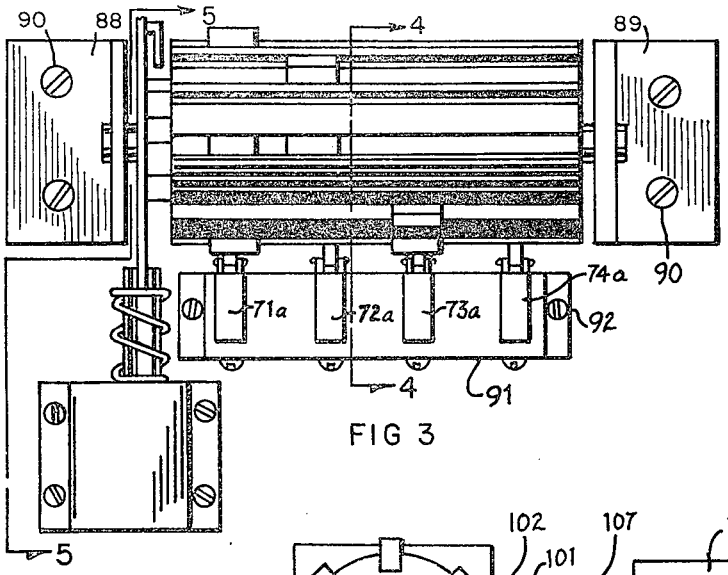
FIG. 3 is an enlarged plan view of the yarn feed program control means.
Figure 4:
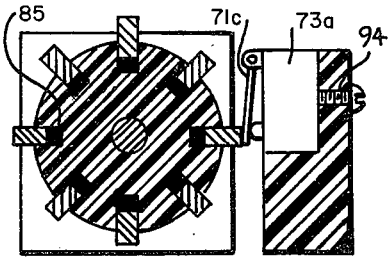
FIG. 4 is a sectional view taken along lines 4 — 4 of FIG. 3.

As shown in FIGS. 3 –6, a rotary switch control means 80 is provided for closing selected combinations of the resistor switches 71*a* – 74*a* with each revolution of the turntable 20. The rotary switch control means includes a cylindrical drum 81 having a plurality of circumferentially spaced axially extending grooves 82. Grooves 82 are adapted to receive elongated switch making bars 83. Each of the switch making bars includes a portion which is complimentary to the groove and includes a number of switch making lobes 83*a*. A switch making lobe 83*a* is provided on a bar 83 in accordance with the desired combination of switches 71*a* – 74*a* to be closed. The switch making bars 83 are held in a set position within the axially extending grooves 82 by means of permanent magnets 85, as shown in FIG. 4. Switch control drum 80 is provided with an axially extending indexing gear 86 having a plurality of indexing gear teeth 87. Switch control drum 80 includes an axial support shaft which is rotatably supported by a pair of upstanding support brackets 88, 89. Brackets 88, 89 are supported in spaced fixed relationship within the control housing 70 by a conventional screw means 90.

As shown in FIGS. 3 and 4, the resistor switches 71*a* – 74*a* are supported in a pillow block 91 adjacent the switch control drum surface so that when the switch drum is advanced to an angular set position such that a switch making lobe 83*a* is aligned with one of the switches, the switch will be moved to a closed position. Switch supporting pillow block 91 is secured in a set position within control housing 70 by conventional threaded screw connecting means 92. Switches 71*a* – 74*a* are provided with a control arm 71*c* – 74*c*, respectively, are operatively associated with conventional micro-switch means supported in the switch housing and are operable when rotated in a clockwise direction, as shown in FIG. 4, for effecting a closure of the switches. The switches are secured in a set position within the pillow block 91 by a conventional connecting bolt means 94.

Figure 5:
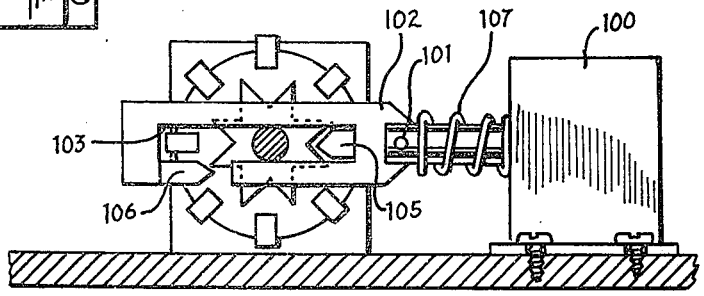
FIG. 5 is a vertical sectional view taken along lines 5 — 5 of FIG. 3.
Figure 6:
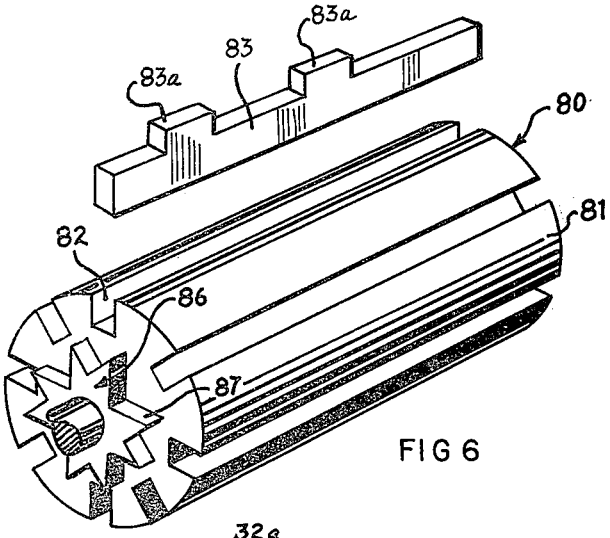
FIG. 6 is an enlarged exploded perspective view of a program control drum.

The switch control drum 80 is selectively advanced in response to each revolution of the turntable 20 so that the next adjacent switch making bar 83 will be angularly displaced to a switch closure position adjacent switches 71*a* – 74*a*. The indexing movement of switch control drum 81 is effected by means of a conventional eleectric solenoid 100. Solenoid 100 is operatively connected through a solenoid plunger 101 to an indexing link member 102. Indexing link member 102 is provided with an elongated slot 103 which is supported in slidable relationship relative to the switch drum shaft and adjacent the support bracket 88, as shown in FIG. 3. The operating link 102 is provided with a pair of outwardly displaced and formed indexing teeth 105, 106 which are operatively associated with the switch drum gear teeth 87 and are operable for effecting angular displacement of the switch drum in response to each operation of solenoid 100. When solenoid 100 is energized, the operating link 102 will be pulled to the right, as shown in FIG. 5. A rightward removement of operating link 102 will withdraw the gear driving tooth 105 from the gear tooth 87 and will cause the gear driving tooth 106 to engage and effect a clockwise rotation of switch control drum 81 a predetermined angular rotation. After the solenoid 100 is deenergized, compression spring 107 will advance the operating link 102 to the left causing the driving tooth 105 to engage a portion of the next adjacent gear tooth 87 to thereby advance the switch control drum an additional angular displacement to cause the next adjacent switch making bar to be aligned with the switch control arms 71*c* – 74*c*, respectively. The switch making arms which are positioned adjacent lobes 83*a* will be moved to a closed switch operating position to cause current to flow through the respective resistors 71 – 74, respectively. The gear driving teeth 105 – 106 are detailed in radial displacement so that one of the gear driving teeth 105 is always in engagement with the drum gear teeth 87 to maintain control and prevent free wheeling of the switch drum.

Referring now to FIG. 1, the indexing solenoid 100 is caused to be energized with each revolution of the turntable 20 by means of a reed switch 110. Switch 110 is supported on the inner surface of a downwardly projecting hub member 111. Hub member 111 is secured to the underside of pressure plate 40 by conventional connecting bolt means 112. Switch 110 is normally supported in an open non-conducting position and is moved to a closed conducting position by means of a permanent magnet 114. Permanent magnet 114 is elongated and is supported in an upstanding position by means of a support bracket 115. Bracket 115 is secured to the upper surface of turntable 20 by conventional connecting bolt means 116. Thus, it can be seen that as the permanent magnet 114 is angularly advanced relative to the reed switch 110, switch 110 will be moved to a closed position thereby energizing the control solenoid 100.

As shown in FIG. 7, power is supplied to the variable resistor control means by operation of the manual control switch 32, as shown in FIG. 1. When switch 32 is moved to a closed position, current is conducted to a conventional variable speed control means 32*a* for effecting operation of the turntable drive motor 25. Current will be conducted from the variable speed control means 32*a* to the input line of the variable resistor means and will be allowed to return by a conventional ground line operatively associated with the variable resistor control described above.

Figure 8:
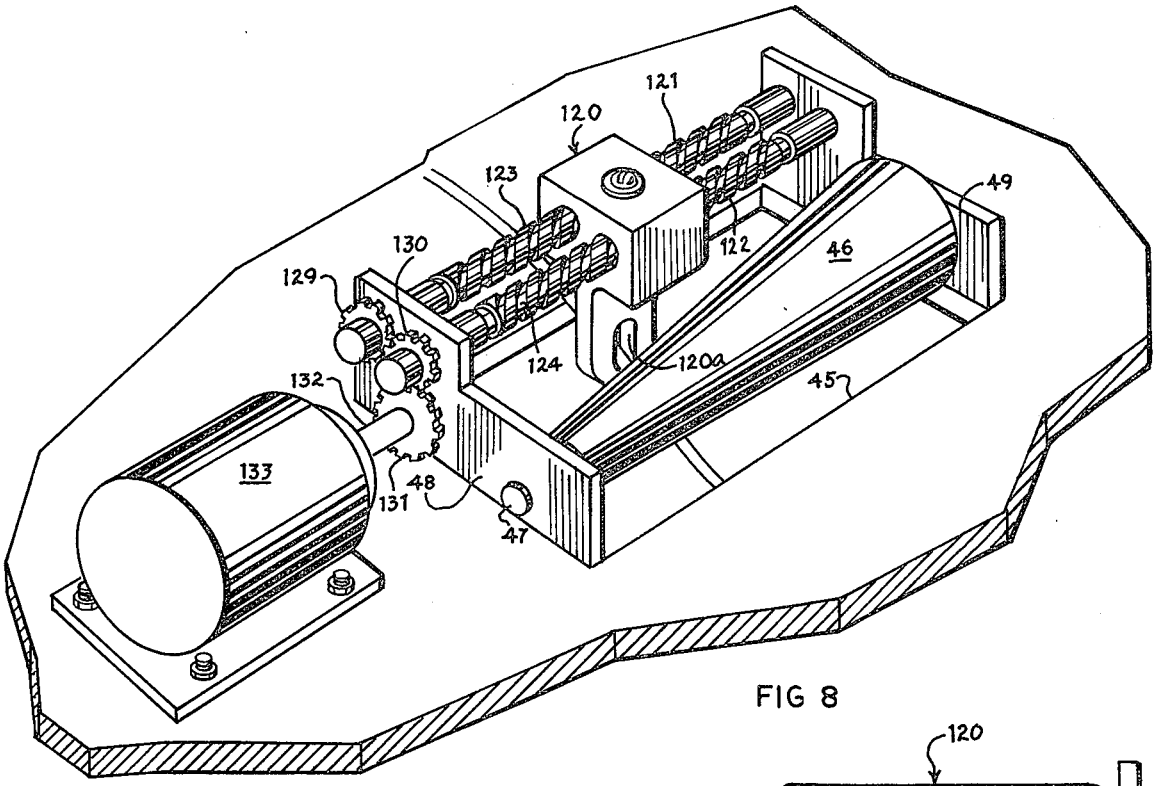
FIG. 8 is an enlarged fragmentary perspective view of a second embodiment of the yarn feed guide control means.
Figure 9:
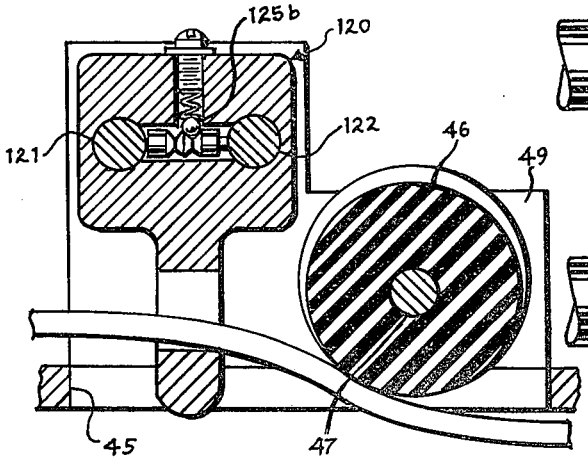
FIG. 9 is an enlarged vertical sectional view taken transversely through the feed guide element shown in FIG. 8.
Figure 10:
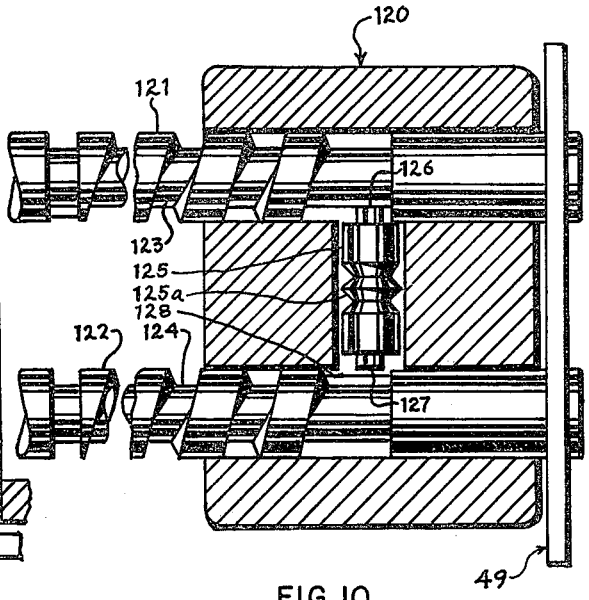
FIG. 10 is an enlarged fragmentary top plan view of the guide element shown in FIGS. 8 and 9, with certain portions broken away and shown in section for purpose of clarity.

As shown in FIGS. 8 – 10, a second embodiment of the yarn feed means is provided for effecting radial displacement of the yarn in the forming of the sinuous waves in the yarn package. The second embodiment includes a yarn guide element 120 which is supported by a pair of shafts 121, 122. Shafts 121, 122 are rotatably supported in upstanding brackets 48, 49. Shafts 121, 122 are provided with helically formed grooves 123, 124, respectively. The helically formed grooves 123, 124 are adapted to be selectively engaged with a groove follower 125. Groove follower 125 is supported in a transversely extending opening formed in the follower 120. Groove follower 125 includes projecting end portions 126, 127. Projecting end portions 126 is adapted to be selectively engaged within helical groove 123 and projecting end portion 127 is adapted to be selectively engaged with helical groove 124. Movement of groove follower 125 into the selected groove is effected by means of a camming lobe located on the leftmost end of groove 123 and by a camming lobe 128 which is located on the rightmost end of groove 124.

As shown in FIGS. 9 and 10, the groove follower 125 includes follower detent portions 125*a* which are adapted to cooperate with a spring loaded ball teeth detent member 125*b* for holding the groove follower in the adjusted positions.

As shown in FIG. 8, the helically grooved shafts 121, 122 are provided with extending portions having enmeshing gears 129, 130. Gear 130 is connected in drive relationship with a motor drive gear 131. Motor drive gear 131 is fixed to motor drive shaft 132 supported and driven by a conventional electric drive motor 133. The gear driving relationship of helically grooved shafts 121, 122 will cause the shafts to be rotated in opposite directions. The rotation of the drive gears 129, 130 are detailed such that helically grooved shaft 122 will rotate in a clockwise direction and helically grooved shaft 121 will rotate in a counterclockwise direction. With the groove follower 127 located in groove 124, the follower is advanced axially to the right, as shown in FIGS. 8 and 9, until the groove follower projecting end 127 is engaged by camming lobe 128. When camming lobe 128 contacts the groove follower projection 127, the groove follower 125 is advanced upwardly, as shown in FIG. 10, until the projection 127 is clear of groove 122 and until the projection 126 is engaged with the helical groove 123. A continued counterclockwise rotation of shaft 121 will cause the helical groove 123 to move the yarn guide element 120 to the left, as shown in FIG. 8, until the follower projection 126 is contacted and moved out of the groove by the camming lobe associated therewith. Thus it can be seen by rotating the helically grooved shafts 121, 122 in opposite direction as indicated above, the yarn guide element 120 will be reciprocatingly advanced along the length of slot 45. The yarn guide element 120 is provided with an opening 120*a* through which yarn is threaded so that the yarn can be advanced beneath the conical shaped guide roller 46 and into the area beneath the pressure plate 40 and the rotary turntable 20.

Figure 11:
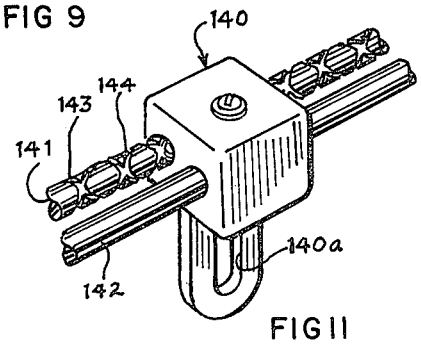
FIG. 11 is a fragmentary perspective view of a third embodiment of a yarn feed guide element control means.

As shown in FIG. 11, a third embodiment of the yarn guide element is shown and generally represented by the reference numeral 140. The yarn guide element 140 is provided with an opening 140*a* through which yarn is threaded in a yarn guiding operation. Yarn guiding element 140 is supported for reciprocating movement by a pair of shafts 141, 142. Shaft 141 is provided with a pair of oppositely directed helical grooves 143, 144. The helical grooves 143, 144 are adapted to cooperate with conventional groove follower means similar to the groove follower means utilized in a fishing reel for effecting a reciprocating movement of the yarn guide element 140 along the length of the shaft 141. Shaft 142 includes a smooth surface and is provided as a stabilizer shaft to prevent follower 140 from rotating about the helically grooved shaft 141. The helically grooved shaft 141 is connected by conventional drive means to the drive motor 133 described above. Motor 133 of the embodiments shown in FIGS. 8 – 11 is controlled from the drive control means 70 described herein above.

Figure 12:
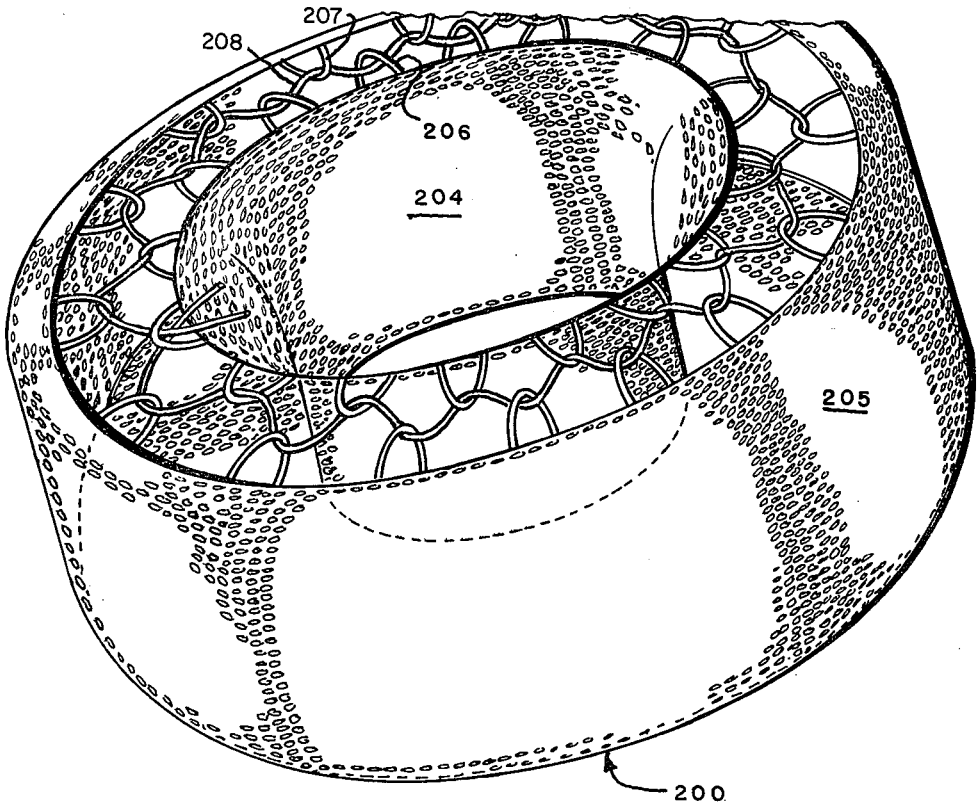
FIG. 12 is an enlarged perspective view of a package of yarn formed to include the features of the present invention, with the package of yarn being contained in an open mesh yarn bag.
Figure 13:
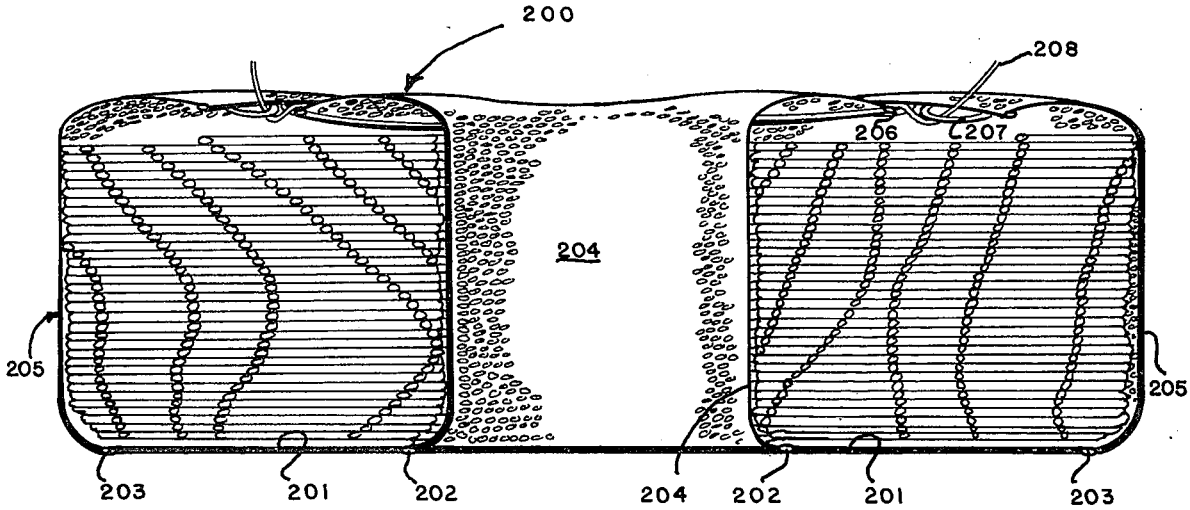
FIG. 13 is an enlarged vertical cross sectional view taken transversely through the yarn package shown in FIG. 12.

As shown in FIGS. 1, 12 and 13, the yarn package formed to include the pattern of the present invention is contained in the yarn package supporting bag which is generally represented by the reference numeral 200. The yarn package supporting bag 200 is constructed of conventional net material having a transverse array of openings through which yarn treatment medium can readily flow to effect treatment of the yarn in a processing operation and constructed of a heat resistant material, such as polypropylene. The yarn supporting bag 200 is constructed substantially doughnut in configuration and includes an angular supporting bottom or base member 201. Base member 201 is provided with an inner circumferential edge 202 and an outer circumferential edge 203. An inner wall member 204 is secured to the inner edge of annular base support member 201 and extends upwardly therefrom, as shown in FIG. 13. An outer wall member 205 is secured to the outer circumferential edge 203 and extends vertically upward in substantially parallel relationship to inner wall 204. The wall members 204, 205 define an annular cavity in which the yarn package is formed and contained in a yarn processing operation. The upper edge of inner wall member 204 is provided with a plurality of circumferentially spaced loop members 206 and the upper edge of outer wall member 205 is provided with a plurality of circumferentially spaced loop members 207. The loop members 206, 207 are angularly offset relative to each other and are adapted to be secured in a top closure position, as shown in FIG. 12, by means of a flexible connecting member 208. In a package closing position, the flexible element 208 is threaded alternately between the loops 206, 207 with the ends of the flexible connecting member being secured to each other to hold the top closure in a secured or in a closed position to prevent the yarn from escaping the bag support means.

In a yarn package forming operation, the bag support means is supported such that the support base 201 is supported on the annular support member 20*a*, as shown in FIG. 1, with the two wall members 204, 205 being folded back into the area beneath the turntable 20 and the annular support member 20*a*. During a yarn packaging operation, the yarn package will be formed on the upper surface of the base support member 201 to a predetermined height, after which the manual control switch 32 will be moved to an off position stopping rotation of the turntable 20 and stopping the introduction of yarn to the area between the turntable and pressure plate. After the turntable 20 has stopped rotating, pressure plate 40 is removed from the support post 41, 42 and is held in a displaced location by conventional counter balance means (not shown). The side walls 204, 205 of the yarn bag are then moved upwardly to engage the inner and outer surface of the yarn package, with the loops folded over the upper surface of the yarn package and the flexible element 208 threaded through the loops in manner as described above to effect a closure of the yarn supporting bag.

It now becomes apparent that the above described illustrative embodiments of a yarn packaging forming apparatus and of a yarn bag support means are capable of obtaining the aboved stated objects and advantages. It is obvious that those skilled in the art may make modifications in the details of construction without departing from the spirit of the invention which is to be limited only by the scope of the appended claims.

What is claimed is:

1. Apparatus for use in forming a package of yarn comprising, in combination: frame support means, a turntable rotatably supported on said frame support means, means for effecting rotation of said turntable, a pressure plate non-rotatably supported on said frame support means for pressure engagement with said turntable and for axial displacement away from said turntable to provide a yarn package forming area therebetween, said pressure plate defining a slot therein, means for introducting a length of yarn into the area between said turntable and said pressure plate whereby rotation of the turntable pulls the yarn onto and accumulates on the turntable and into the area between the turntable and the pressure plate including a yarn guide element supported on said pressure plate adjacent said slot for effecting radial reciprocating movement of the yarn as the yarn moves into the slot, a variable speed motor drive means for effecting a plurality of different radial reciprocating speeds of said yarn guide element and a selectively programmable means for effecting a predetermined sequence of operation of the speeds of the variable speed motor, so as to form a number of overlapping revolutions of yarn and a number of sinuous shaped wave patterns in each revolution of said turntable, with each revolution having a number of angularly displaced radial dimensions and being formed concentrically around the axis of said turntable and wherein said controlled radial displacement of said yarn and rotation of said turntable effects angular displacement of successive revolutions of yarn application to said turntable to produce an overlapping relationship between adjacent revolutions.

2. Apparatus as defined in claim 1 further characterized in that said programmable means includes a variable resistor input means to said motor drive means, and wherein said variable resistor input means includes means for selectively connecting a number of variable capacity resistors in series for effecting operation of said motor drive means in each of said variable drive speeds.

3. Apparatus as defined in claim 2 further characterized in that said yarn guide element is supported on a radially extending shaft, and reciprocating drive means including an eccentric rotating means for effecting said radial reciprocating movement of said yarn guide element.

4. Apparatus as defined in claim 1 further characterized in that said programmable means for effecting said variable reciprocating speed of movement of said yarn guide element includes means for automatically adjusting the speed of said motor drive means in response to each rotation of said turntable.

5. Apparatus for forming a package of yarn comprising, in combination: frame support means, a turntable rotatably supported on said frame support means, means for rotating said turntable, a pressure plate non-rotatably supported on said frame support means for pressure engagement with said turntable and for axial displacement away from said turntable to provide a yarn package forming area therebetween, means for introducing a length of yarn into the area between said turntable and said pressure plate whereby the friction of said turntable causes the yarn to be pulled into the area between the turntable and the pressure plate and move with said turntable, means for reciprocating the yarn in a rectilinear path oriented approximately radially with respect to the center of said turntable during each rotation of said turntable and means for selectively varying the frequency of the reciprocation of the yarn with respect to the speed of the turntable whereby the reciprocating radial displacement of the yarn being draw into the area between the turntable and the pressure plate and simultaneous rotation of said turntable with respect to the pressure plate produces a number of sinuous shaped wave patterns in each revolution of said turntable and angular displacement about the turntable of the successive sinuous wave patterns to produce an overlapping relationship between adjacent revolutions.

6. Apparatus for use in forming a package of yarn comprising, in combination: frame support means, a turntable supported by said frame support means, a pressure plate supported on said frame support means for axial movement relative to said turntable, power means for effecting rotation of said turntable with respect to said pressure plate, means for introducing a length of yarn through said pressure plate into the area between said turntable and said pressure plate and for effecting rectilinear reciprocating movement of the yarn moving through said pressure plate radially with respect to said turntable during each revolution of said turntable and means for selectively varying the frequency of the reciprocation of the yarn with respect to the speed of the turntable whereby rotation of the turntable and the reciprocation of the yarn as the yarn moves through the pressure plate causes the yarn to advance around and be applied to and accumulate on the turntable so as to form a number of overlapping layers of yarn in a sinusoidal pattern in an annular arrangement with angular displacement about the turntable of the successive sinusoidal patterns with the progressive accumulation of overlapping layers of yarn being operable to cause axial displacement of the pressure plate with respect to the turntable.

7. Apparatus as defined in claim 6 further characterized in that said pressure plate is provided with a radially extending slot, and wherein said means for introducing said length of yarn into the area between said turntable and said pressure plate includes yarn guide means supported on said pressure plate adjacent said slot for effecting said radial reciprocating movement of said yarn as the yarn is advanced through said slots in said pressure plate and to said area between said pressure plate and said turntable.

8. Apparatus as defined in claim 7 further characterized in that said yarn guide means includes power drive means and a yarn guide element for effecting said radial reciprocating movement of said yarn, and wherein said power drive means includes said means for selectively varying the frequency of the reciprocating movement of said yarn.

* * * * *